US009038817B2

(12) United States Patent
Connolly et al.

(10) Patent No.: US 9,038,817 B2
(45) Date of Patent: May 26, 2015

(54) AMMUNITION PACKAGING

(71) Applicant: Tac-Pac L.L.C., Boise, ID (US)

(72) Inventors: Andrew B. Connolly, Boise, ID (US); Dennis M. VanAcker, Meridian, ID (US)

(73) Assignee: TAC-PAC L.L.C., Boise, ID (US)

( * ) Notice: Subject to any disclaimer, the term of this patent is extended or adjusted under 35 U.S.C. 154(b) by 38 days.

(21) Appl. No.: 14/049,174

(22) Filed: Oct. 8, 2013

(65) Prior Publication Data

US 2015/0096907 A1 Apr. 9, 2015

(51) Int. Cl.
*F42B 39/00* (2006.01)
*F42B 39/26* (2006.01)
*B65B 5/08* (2006.01)

(52) U.S. Cl.
CPC .. *F42B 39/26* (2013.01); *B65B 5/08* (2013.01)

(58) Field of Classification Search
CPC ..... F42B 39/00; F42B 39/02; F42B 39/26; F42B 39/14; B65B 5/08
USPC ..... 206/3, 589, 590, 591, 419, 1.5; 224/253, 239, 203, 252, 240, 241, 914; 220/306, 323, 324
See application file for complete search history.

(56) References Cited

U.S. PATENT DOCUMENTS 2,465,644 A * 3/1949 Graves ..... 220/507
3,923,152 A * 12/1975 Minneman ..... 206/3
4,387,805 A * 6/1983 Lanius ..... 206/230
D278,096 S * 3/1985 Walker et al. ..... D3/295
4,757,894 A * 7/1988 Schreckenstein ..... 206/3
4,811,836 A * 3/1989 Minneman ..... 206/3
4,872,608 A * 10/1989 Lake ..... 206/521.1
4,942,991 A * 7/1990 Lyons ..... 224/196
D329,140 S * 9/1992 Maricle ..... D3/225
5,839,583 A * 11/1998 Pope et al. ..... 206/704
D405,363 S * 2/1999 Herbruck ..... D9/762
D424,933 S * 5/2000 Albright et al. ..... D9/423
6,478,158 B2 * 11/2002 Gaffney et al. ..... 206/705
D466,802 S * 12/2002 Davkovski ..... D9/757
7,255,231 B2 * 8/2007 Andrews et al. ..... 206/521.1
7,353,951 B2 * 4/2008 Vovan ..... 206/521.8
D569,243 S * 5/2008 Kidd et al. ..... D9/425
7,395,922 B1 * 7/2008 Sinha ..... 206/3
7,597,199 B1 * 10/2009 Rochelo ..... 206/703
7,673,747 B2 * 3/2010 Yoda ..... 206/320
D641,256 S * 7/2011 Fisher ..... D9/721
8,091,731 B2 * 1/2012 Kidd et al. ..... 220/788
8,167,166 B2 * 5/2012 Kidd et al. ..... 220/835
D709,323 S * 7/2014 Brown ..... D7/402
2005/0189256 A1 * 9/2005 St-Onge ..... 206/521.1

(Continued)

*Primary Examiner* — Anthony Stashick
*Assistant Examiner* — Ernesto Grano
(74) *Attorney, Agent, or Firm* — Holland Law Office PLLC

(57) ABSTRACT

The present invention is directed to an ammunition package that includes a container having a bottom panel and an attached side panel. The inner face of the bottom panel is formed having a plurality of cartridge receiving sockets. An inner lid, foldable between an open position and a closed position, is attached at an upper edge of the container. Similarly an outer lid is attached to the container, in such a manner that the outer lid is foldable over the inner lid. In a preferred embodiment, an inner face of the inner lid is formed having a plurality of upper cartridge receiving sockets that align with the lower cartridge receiving sockets when the inner lid is positioned in the closed position. In the preferred embodiment, an upper face of the inner lid is formed as a tray when the inner lid is in the closed position.

18 Claims, 6 Drawing Sheets

(56) References Cited

U.S. PATENT DOCUMENTS

2006/0060493 A1* 3/2006 Marshall ..... 206/521.1
2007/0256954 A1* 11/2007 Vovan ..... 206/521.1
2011/0174639 A1* 7/2011 Sibley ..... 206/3
2013/0118922 A1* 5/2013 McClaughry et al. ..... 206/3

* cited by examiner

AMMUNITION PACKAGING

BACKGROUND OF THE INVENTION

1. Technical Field

The present invention relates generally to packaging and more particularly to a container adapted for packaging a plurality of substantially cylindrical parts, for instance ammunition for firearms.

2. Background

Ammunition for small arms including handguns and rifles has, for at least a century, been packaged for sale to the consumer in cardboard or pressed paper boxes. Individual rounds have commonly been placed in any of a number of matrices formed also of pressed paper or cardboard, and more recently a polystyrene foam or other drillable or otherwise formable substrate.

These containers are found lacking in a number of regards. For instance if the packaging is subjected to moisture of any significant amount, decomposition begins rapidly. While ammunition is typically stored in dry environments, it is not uncommon for ammunition and its packaging to be subjected to extreme environmental conditions including moisture. Needless to say, a decomposing container does not serve well to contain.

Similarly, the highly decomposable pressed paper or cardboard containers have a minimal probability of surviving for reuse. Additionally, cardboard and pressed paper boxes box have a diminishing appeal for display purposes particularly in light of developments in recyclable plastics.

Additionally, paper based packaging provides a minimum level of security for the product while on the shelf. While a rectangular pressed paper box provides a convenient configuration for stacking and storage, the benefits of traditional packaging end there. As with any product, the consumer of ammunition has a propensity towards seeing the product being purchased. Possibly the single most effective marketing aid, the ability to see the product without removing it from the package, is defeated with a cardboard or pressed paper box. With a paper product carton or box, the consumer must open the container in order to see the product. Often as not, paper product cartons and boxes are left open after inspection of the product.

Additionally, traditional paper product carton packaging for ammunition has traditionally served the sole purpose of containing cartridges without consideration for providing container configurations that may be employed for containing other materials, for instance spent brass, manufacturer literature, advertisements, coupons or the like.

Therefore an object of the present invention is to provide packaging for ammunition that provides increased durability, resistance to moisture and security for the product while on the shelf as well as increased visibility of the product and therefore improved marketability for the product.

Advantage may also be found in providing packaging that allows for a decrease in the number of container sizes that must be held in inventory to package the majority of available calibers. Therefore another object of the present invention is to provide a reduced number of container sizes that must be held in inventory to package the majority of available calibers.

Advantage may also be found in providing packaging for ammunition that includes functionality beyond serving as a product container for containing cartridges that is configured for containing other materials, for instance spent brass, manufacturer literature, advertisements, coupons or the like. Hence, another object of the present invention is to provide packaging for ammunition that includes functionality beyond serving as a product container for cartridges.

SUMMARY OF THE INVENTION

Accordingly, the present invention is directed to an ammunition package that includes a container base having a bottom panel and a side panel attached to and extending upwardly from the bottom panel. The inner face of the bottom panel is formed having a plurality of cartridge receiving sockets. An inner closure element or lid, foldable between an open position and a closed position, is attached at an upper edge of the container base. Similarly an outer closure element or lid is attached to the container base, in such a manner that the outer closure element is foldable over the inner closure element. In a preferred embodiment, an inner face of the inner closure element is formed having a plurality of upper cartridge receiving sockets that align with the lower cartridge receiving sockets when the inner closure element is positioned in a closed position.

An interior surface of the container base includes a stepped configuration defined by a plurality of lands. The lands provide additional structural support and rigidity for the container base. A plurality of snap-in plate retainers are formed above the first land on the interior surface of the container base. A cartridge stabilization plate is configured to be held in position against the first land by the snap-in plate retainers. The cartridge stabilization plate includes a plurality of apertures sized according to the caliber of the ammunition cartridge being packaged. When the cartridge stabilization plate is snapped into position under the retainers, the apertures align with both the upper and the lower cartridge receiving sockets to further reduce movement of the cartridges in the package. According to the present invention, three package sizes will accommodate one-hundred percent of the world's handgun ammunition sizes, reducing the need for individual packaging required according to current packaging systems.

In a preferred embodiment, the inner closure element also includes an upper face configured as a tray adapted to provide an upwardly facing recess when the inner closure element is folded to the closed position. The tray may be used for a variety of storage purposes including storage of spent brass, manufacturer literature, advertisements, coupons or the like. Cooperating fold-in tray locks formed in the container base and the inner closure element add strength and rigidity to the package and further decrease the possibility of particulate contamination of the packaged ammunition.

The preferred embodiment of the ammunition package also includes a plurality of cooperating locking tabs formed in the corners of the upper land of the container base and at the corners of the second or outer closure element which provide product security and allow reclosing of the package. The cooperating locking tabs may also be heat sealed for added protection from theft or unauthorized opening. A tear-proof adhesive label is adapted be wrapped about a periphery of the ammunition package to provide additional security while the product is on display. The tear-proof adhesive label is preferably printable.

In the preferred embodiment, the ammunition package of the present invention is formed of a transparent thermoplastic, preferably polyethylene terephthalate, (PET). PET is translucent allowing visual inspection of packaged cartridges C. In addition PET may be tinted for individual customer packaging specifications while maintaining product visibility. Additionally, PET will not corrode the brass like traditional foam inserts.

The preferred embodiment of the ammunition package also includes stacking rails or lugs formed on an upper surface of the package that are configured specifically for stacking packages in an interlocking manner by cooperating with a feature or the footprint of the bottom surface of the package.

DETAILED DESCRIPTION

Figure 1:
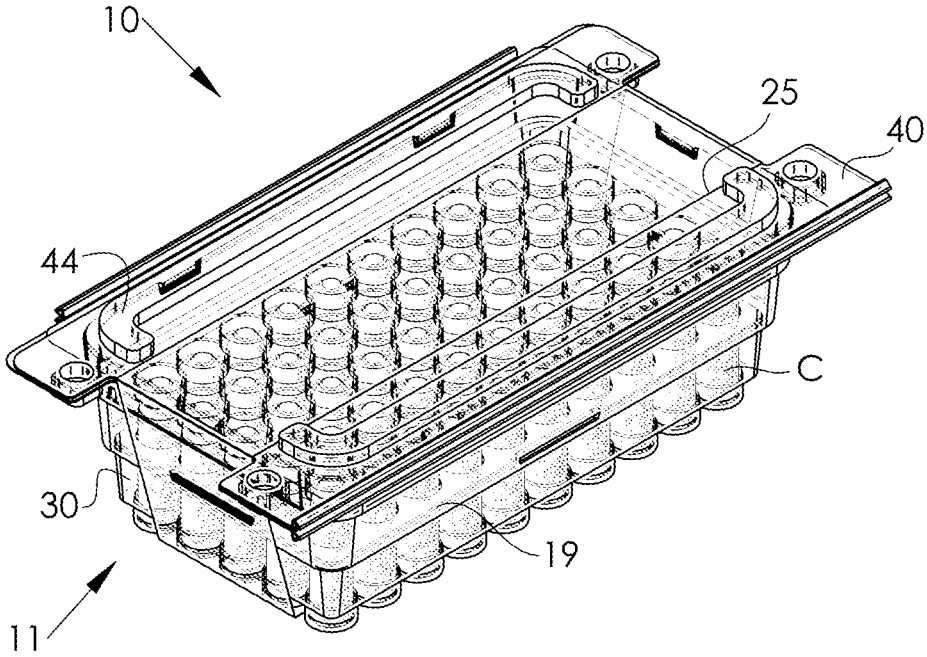
FIG. 1 is a representative isometric view of ammunition packaging according to the present invention.
Figure 2:
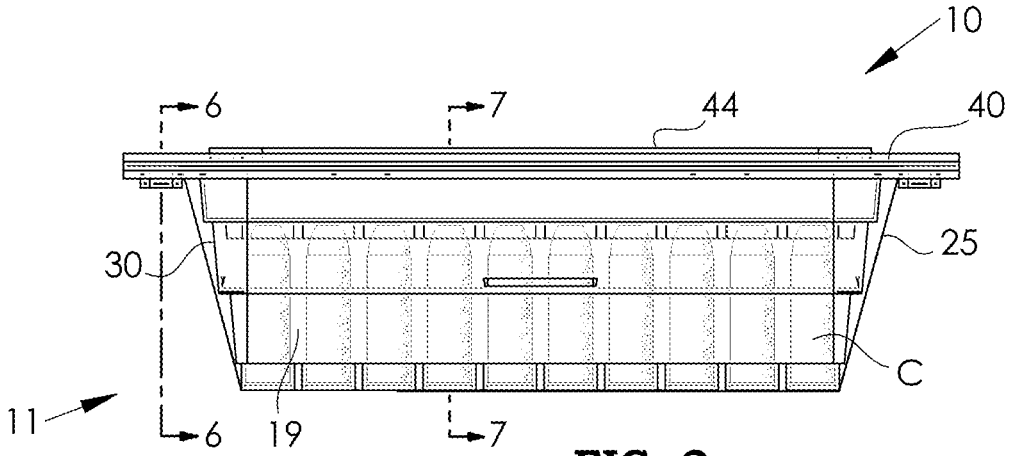
FIG. 2 is a representative side view of ammunition packaging according to the present invention.

FIGS. 1 and 2 show ammunition package 10 including container base 11 including a plurality of side panels 19. Outer closure element 40 covers container base 11. Ammunition package 10 is configured for holding a plurality of cartridges C. In the preferred embodiment, ammunition package 10 is formed of a thermoplastic, preferably polyethylene terephthalate, (PET). In the preferred embodiment at least part of ammunition package 10 is transparent. Tear-proof label 25 is shown securely wrapped about periphery 30 of ammunition package 10. FIG. 1 also shows outer closure element 40 formed including a pair of side rails 44 adapted for stabilizing a second package, (not shown), when stacked on top of outer closure element 40.

Figure 3:
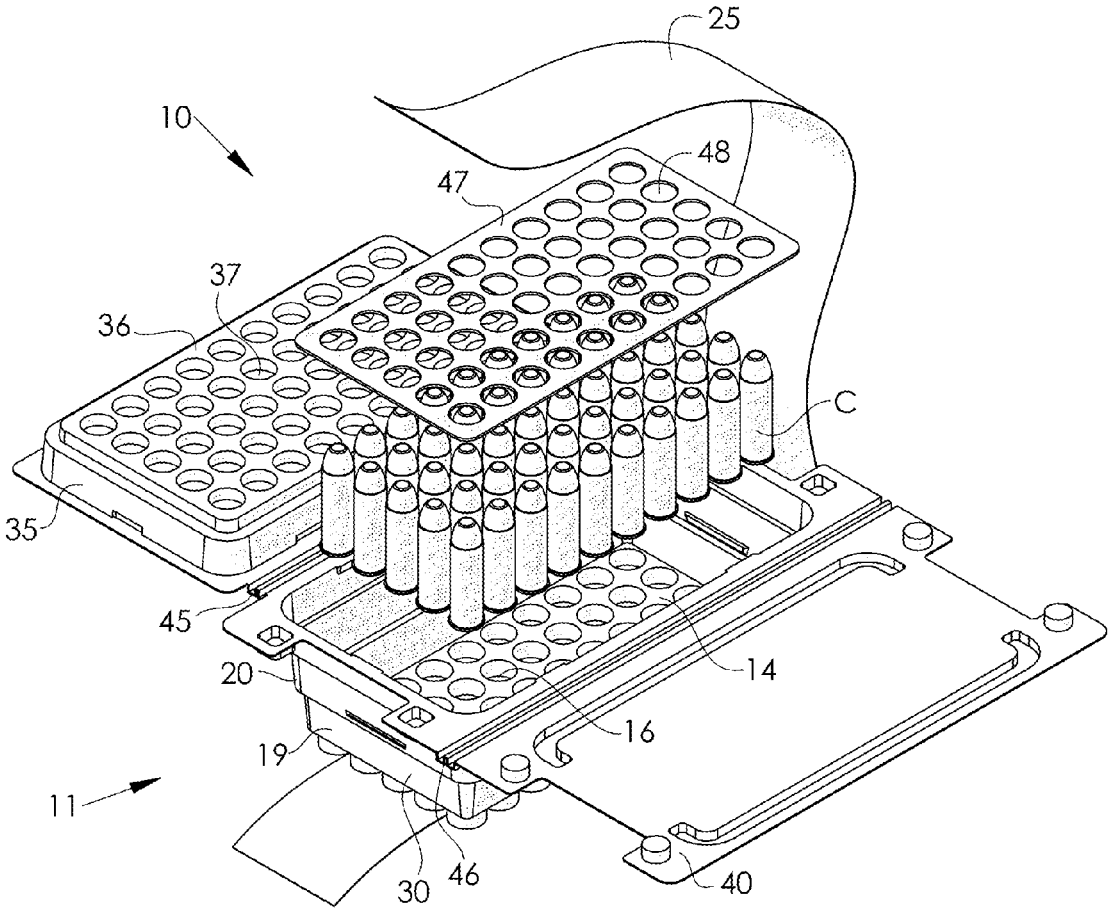
FIG. 3 is a representative isometric exploded view of ammunition packaging according to the present invention.
Figure 4:
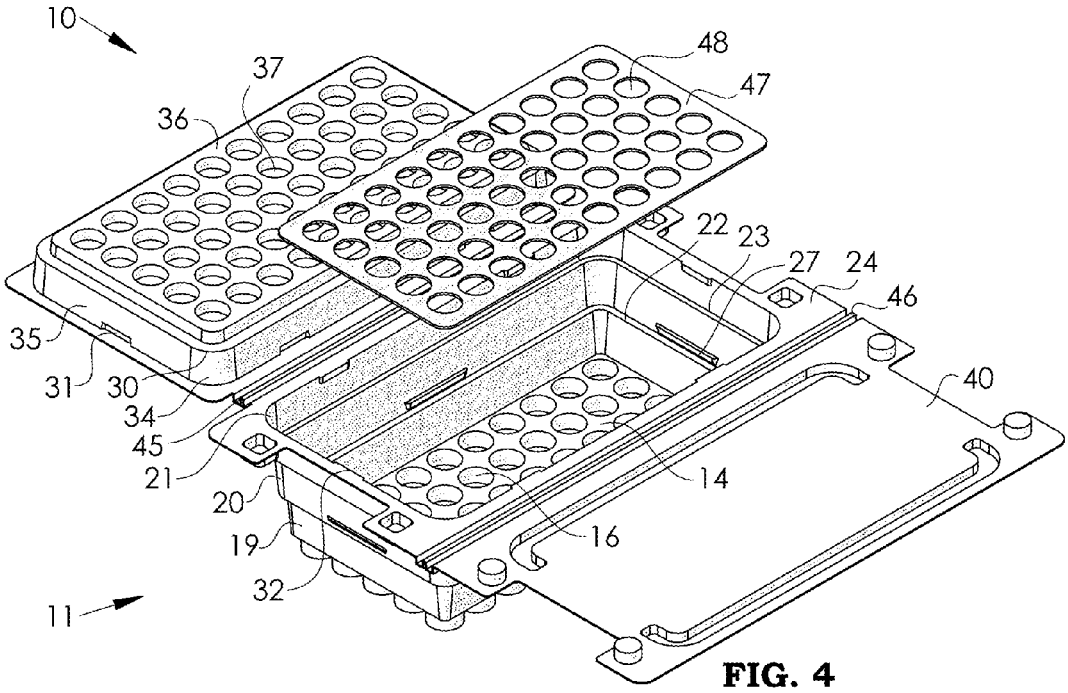
FIG. 4 is a representative isometric view of ammunition packaging according to the present invention.
Figure 5:
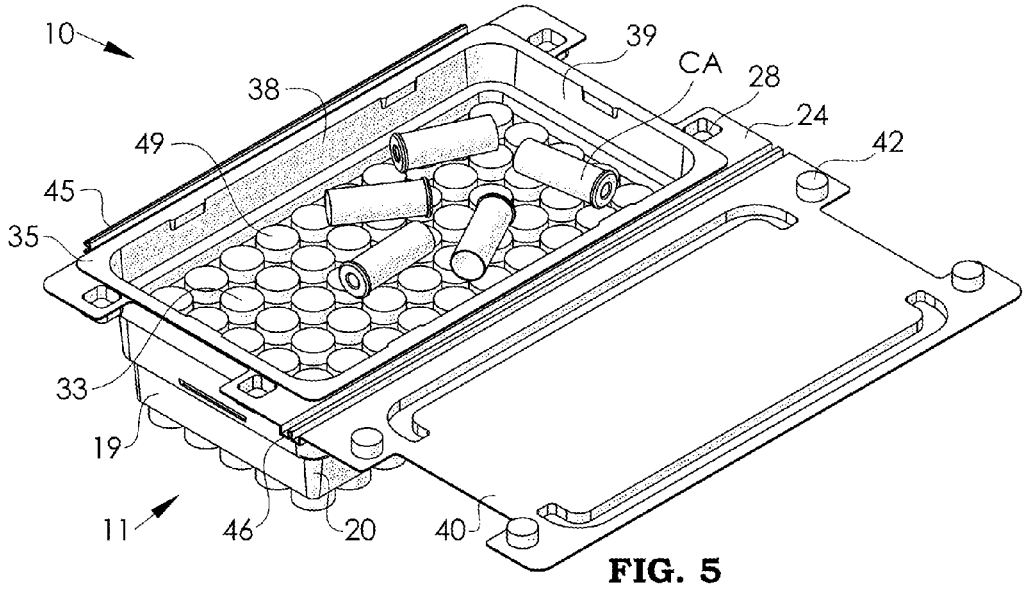
FIG. 5 is a representative isometric view of ammunition packaging according to the present invention.

FIGS. 3-5 show ammunition package 10 including container base 11 having a plurality of side panels 19 that meet forming a plurality of corners 20. Inner closure element 35 attaches to container base 11 at first eight corner hinge 45 and outer closure element 40 attaches to container base 11 at second eight corner hinge 46.

As shown in FIGS. 3 and 4, container base 11 includes bottom panel 14 formed including a plurality of lower cartridge receiving sockets 16. Each lower cartridge receiving socket 16 is sized to receive a range of calibers of cartridge C. Each lower cartridge receiving socket 16 may be configured having a circular cross-section or alternately a polygonal cross-section. With continued reference to FIGS. 3 and 4, inner closure element 35 is formed having a plurality of upper cartridge receiving sockets 37 on inner face 36. Ammunition package 10 may include cartridge stabilization plate 47 formed having a plurality of cartridge stabilization apertures 48 sized for a particular caliber of ammunition. As inner closure element 35 is moved from an open position as shown in FIG. 3 to a closed position as seen in FIG. 5, each of the plurality of upper cartridge receiving sockets 37 align coaxially with one of the plurality of cartridge stabilization apertures 48 formed in cartridge stabilization plate 47, (shown in FIGS. 3 and 4), and one of the plurality of lower cartridge receiving sockets 16, (shown in FIGS. 3 and 4), thereby securing a contained cartridge C in a manner wherein chatter between individual rounds is eliminated and vertical and lateral travel of cartridge within ammunition package 10 is substantially limited.

Referring again to FIG. 3, tear-proof adhesive label 25 is configured to attach about periphery 30 of ammunition package 10 to provide security against undesired opening of ammunition package 10.

Referring to FIG. 4, container base 11 includes a series of lands formed on the plurality of side panels. Specifically as shown, container base 11 includes first land 22, second land 23 and upper land 24. Container base 11 includes a plurality of snap-in plate retainers 27 formed above first land 22.

Referring to FIG. 4 ammunition package 10 is shown including container base 11 formed of a plurality of side panels 19 that meet and join to form a plurality of corners 20. Each corner 20 is formed having concave surface 21. Inner closure element 35 includes a plurality of inner closure element corners 30 each including a convex face 34. As seen in FIG. 4, outer closure element 40 is shown positioned in an open position with respect to container base 11. When inner closure element 35 is closed as shown for instance in FIG. 5, increased rigidity is provided to the structure by the close and cooperating fit of the plurality of convex corners 34 of inner closure element 35, (shown in FIG. 4), with the plurality of concave corners 21, (also shown in FIG. 4), of container base 11. In addition, increased structural rigidity is provided by the fit of inner face 36 of inner closure element 35 against second land 23, when inner closure element 35 is positioned in the closed position as shown in FIG. 5.

FIG. 4 also shows inner closure element 35 including tray engagement first lock element 31. Correspondingly, container base 11 includes tray engagement second lock element 32. When inner closure element 35 is closed, again as shown for instance in FIG. 5, increased rigidity is provided to the structure by the cooperating fit between tray engagement first lock element 31 and tray engagement second lock element 32.

In FIG. 5, ammunition package 10 is shown having inner closure element 35 folded to a closed position with respect to container base 11 at first eight corner hinge 45. In this configuration, inner closure element 35 presents tray 38 in an upright orientation. Inner closure element 35 is formed having upwardly facing recess 33 defined in part by rim 39, a plurality of convex corners 34 and upper face 49 of inner closure element 35. As seen tray 38 may be used for storage of spent casings CA or for instance literature that may accompany the product in ammunition package 10.

Figure 6:
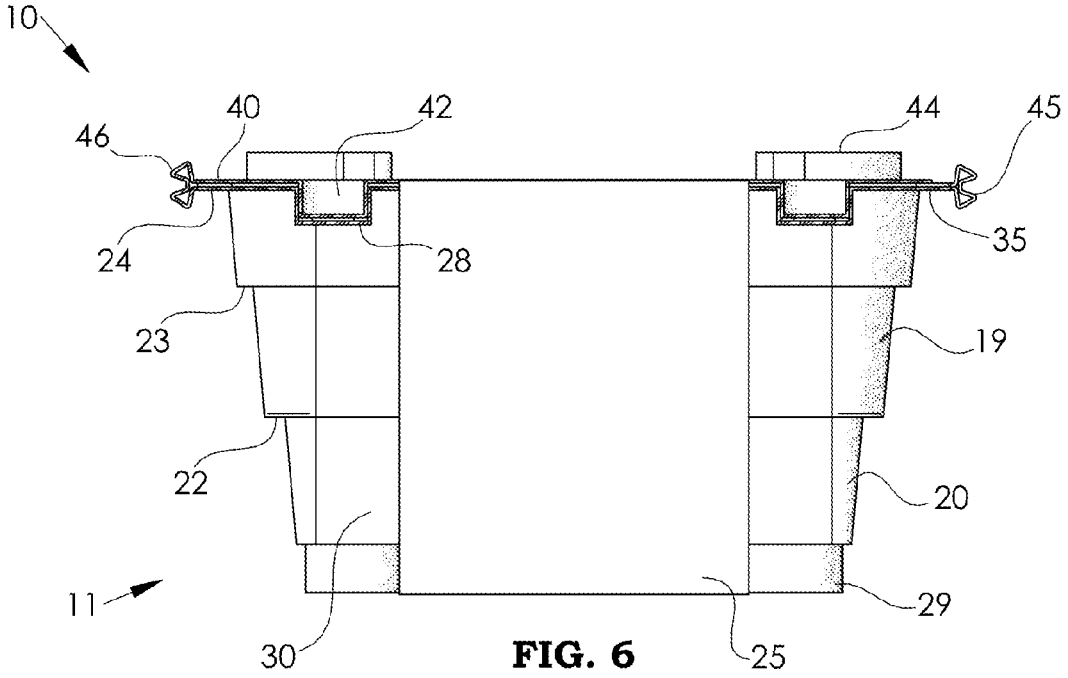
FIG. 6 is a representative cutaway end view of ammunition packaging according to the present invention.

FIG. 6 shows ammunition package 10 including container base 11 formed of a plurality of side panels 19 that meet and join to form a plurality of corners 20. Each of the plurality of sidewalls 19 are formed including first land 22, second land 23 and upper land 24. Inner closure element 35 is attached to container base 11 at upper land 24 by first eight corner hinge 45. Similarly, outer closure element 40 is attached to container base 11 at upper land 24 by second eight corner hinge 46. Outer closure element 40 is formed including a feature defining outer closure element 40 adapted for stabilizing a second package, (not shown), when stacked on top of outer closure element 40. In FIG. 6 the feature comprises a pair of side rails 44 formed on outer closure element 40. Container base 11 is formed having footprint 29 that is configured so as to fit within an area defined between the pair of side rails 44 to stabilize a second package, (not shown). Alternately, packaging may be configured so that a feature defining footprint 29 engages a feature defining outer closure element 40 so as to eliminate displacement of a second package, (not shown), stacked on top of ammunition package 10.

Referring to FIGS. 5 and 6, outer closure element 40 is formed including a plurality of locking tab second elements 42. Container base 11 includes a plurality of locking tab first elements 28 formed in upper land 24. When outer closure element 40 is closed over inner closure element 35 the plurality of locking tab second elements 42 engage the plurality of locking tab first elements 28 formed in upper land 24 to provide for secure closure of ammunition package 10. The fit between the plurality of locking tab first elements 28 and the plurality of locking tab second elements 42 permits heat sealing to provide increased security of the contents of the packaging.

FIG. 6 also shows tear-proof adhesive label 25 configured to attach about periphery 30 of ammunition package 10 to provide additional security for ammunition package 10.

Figure 7:
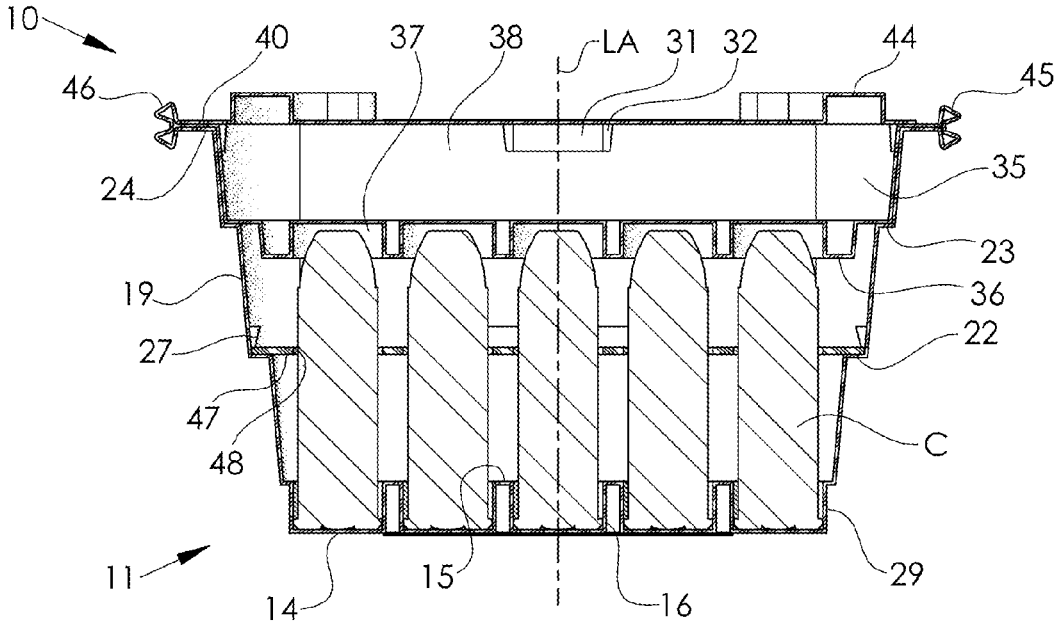
FIG. 7 is a representative cutaway end view of ammunition packaging according to the present invention.

FIG. 7 is a cutaway end view of ammunition package 10 including container base 11 formed of a plurality of side panels 19. Container base 11 includes bottom panel 14 having upper face 15 formed to include a plurality of lower cartridge receiving sockets 16, each of the plurality of lower cartridge receiving sockets 16 including a longitudinal axis LA. Cartridge stabilization plate 47 is shown secured beneath snap-in plate retainer 27. As previously noted, cartridge stabilization plate 47 includes a plurality of cartridge stabilization apertures 48 each sized for a particular caliber of ammunition and each of the plurality of cartridge stabilization apertures 48 lying substantially co-axially to a longitudinal axis LA of one of the plurality of lower cartridge receiving sockets 16.

FIG. 7 also shows inner closure element 35 attached to container base 11 at upper land 24 by first eight corner hinge 45. Inner closure element 35 is shown in a closed position wherein upwardly facing recess 33 forms tray 38. Inner face 36 of inner closure element 35 is shown including a plurality of upper cartridge receiving sockets 37. Each of the plurality of plurality of upper cartridge receiving sockets 37 lie substantially co-axially to a longitudinal axis LA of one of the plurality of lower cartridge receiving sockets 16 when inner closure element 35 is in the closed position. Inner face 36 of inner closure element 35 is also shown supported by second land 23 adding structural rigidity to ammunition package 10.

FIG. 7 also shows the cooperating fit between tray engagement first lock element 31 and tray engagement second lock element 32. With continued reference to FIG. 7, outer closure element 40 is attached to container base 11 at upper land 24 by second eight corner hinge 46. Outer closure element 40 formed including a pair of side rails 44 adapted for stabilizing a second package, (not shown), when stacked on top of outer closure element 40. Container base 11 is formed having footprint 29 that is configured so as to fit within an area defined between the pair of side rails 44 to stabilize a second package, (not shown).

Figure 8:
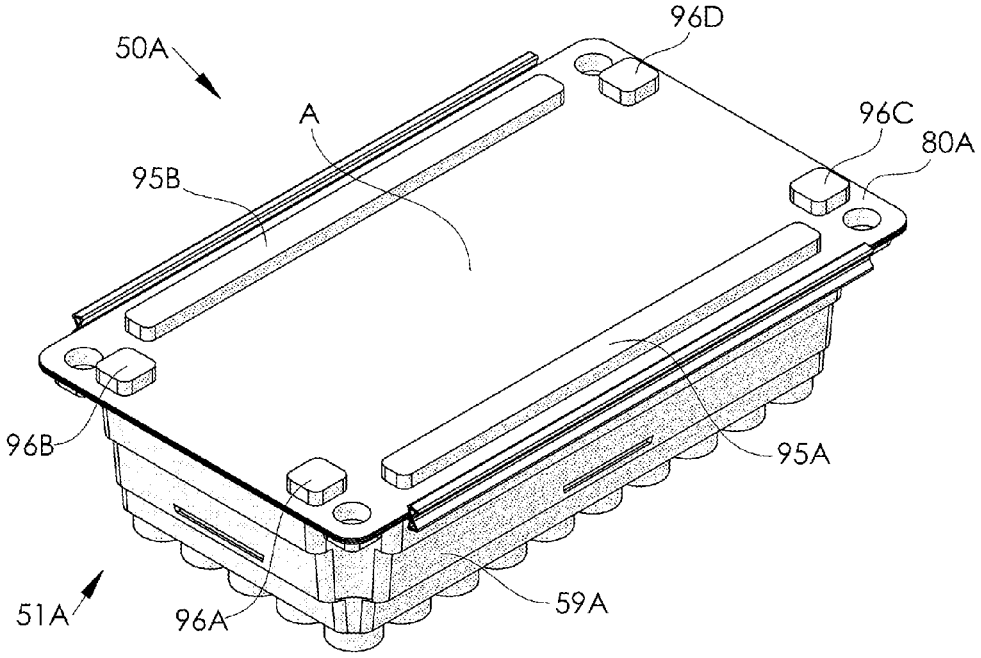
FIG. 8 is a representative isometric view of ammunition packaging according to the present invention.
Figure 9:
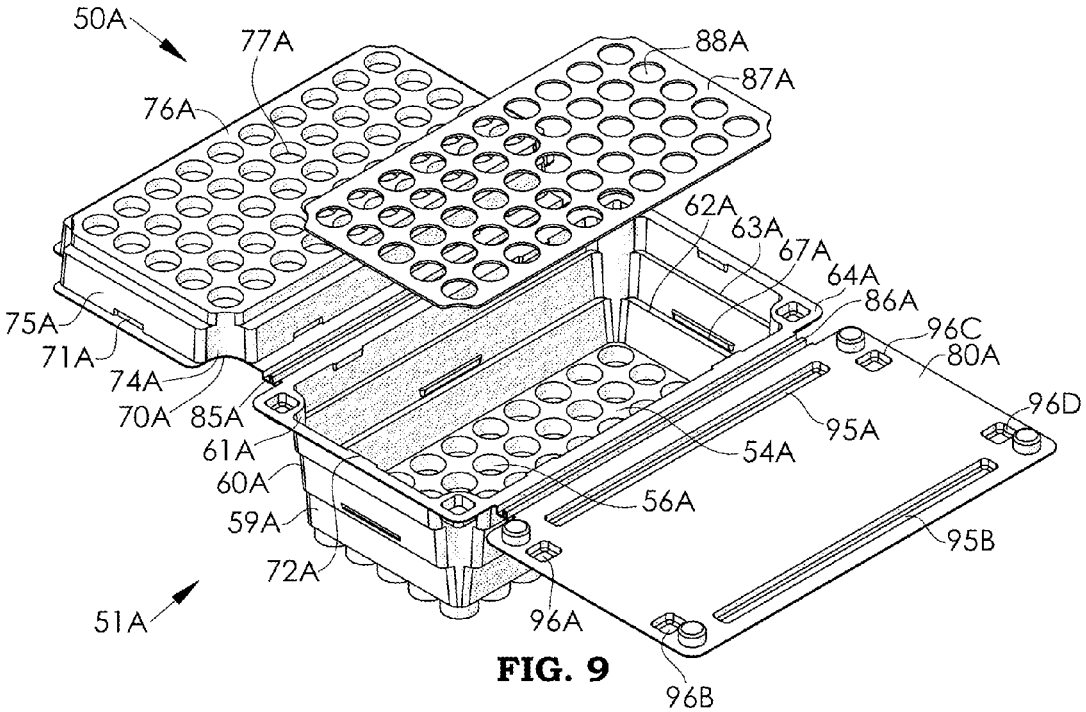
FIG. 9 is a representative isometric view of ammunition packaging according to the present invention.

FIGS. 8 and 9 show an alternate configuration of ammunition package 50A including container base 51A including a plurality of side panels 59A. Outer closure element 80A covers container base 51A. Outer closure element 80A formed including a pair of side rails 95B and 95B which together with lugs 95A, 95B, 95C and 95D are adapted to stabilize a second package, (not shown), when stacked on top of outer closure element 80A.

FIG. 9 shows ammunition package 50A including container base 51A having a plurality of side panels 59A that meet forming a plurality of corners 60A. Inner closure element 75A attaches to container base 51A at first eight corner hinge 85A and outer closure element 80A attaches to container base 51A at second eight corner hinge 86A.

Container base 51A includes bottom panel 54A including a plurality of lower cartridge receiving sockets 56A. Inner closure element 75A is formed having a plurality of upper cartridge receiving sockets 77A on inner face 76A. Ammunition package 50A may include cartridge stabilization plate 87A formed having a plurality of cartridge stabilization apertures 88A sized for a particular caliber of ammunition. As inner closure element 75 is moved from an open position to a closed position, each of the plurality of upper cartridge receiving sockets 77A align coaxially with one of the plurality of cartridge stabilization apertures 88A formed in cartridge stabilization plate 87A and one of the plurality of lower cartridge receiving sockets 56A.

Container base 51A includes a series of lands formed on the plurality of side panels. Specifically as shown, container base 51A includes first land 62A, second land 63A and upper r land 64A. Container base 51A includes a plurality of snap-in plate retainers 67A formed above first land 62A. Cartridge stabilization plate 87A is sized and configured to be held in place beneath the plurality of snap-in plate retainers 67A when cartridge stabilization plate 87A is forced beneath the plurality of snap-in plate retainers 67A, against first land 62.

Each corner 60A of container base 51A is formed having convex surface 61A. Inner closure element 75A includes a plurality of inner closure element corners 70A each including a concave face 74A. Outer closure element 80 is shown positioned in an open position with respect to container base 51A. When inner closure element 75A is closed, increased rigidity is provided to the structure by the close and cooperating fit of the plurality of concave corners 74A of inner closure element 75A with the plurality of convex corners 61A of container base 51A. In addition, increased structural rigidity is provided by the fit of inner face 76A of inner closure element 75A against second land 63A, when inner closure element 75A is closed.

Inner closure element 75A also includes tray engagement first lock element 71A. Correspondingly, container base 51A includes tray engagement second lock element 72A. When inner closure element 75A is closed, increased rigidity is provided to ammunition package 50A by the cooperating fit between tray engagement first lock element 71A and tray engagement second lock element 72A.

Figure 10:
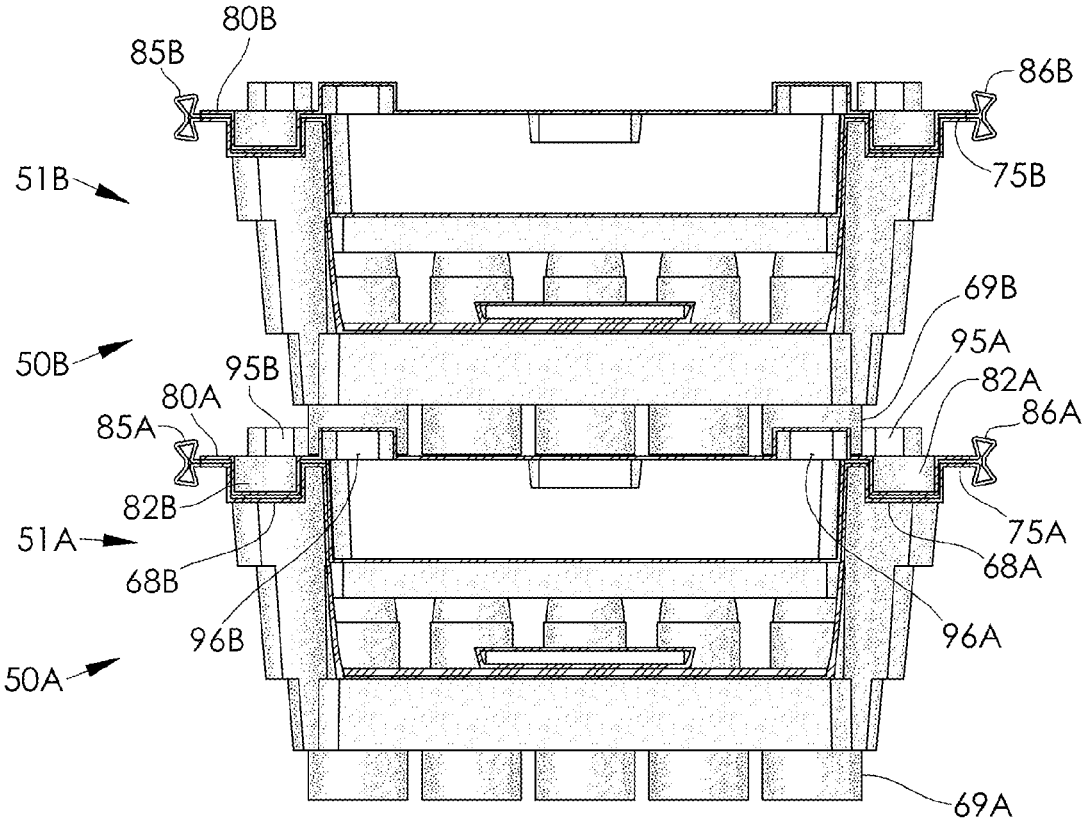
FIG. 10 is a representative cutaway end view of a pair of stacked ammunition packages according to the present invention.

FIG. 10 is a representative cutaway end view of a pair of ammunition packages 50A and 50B, shown stacked, for instance as in a retail display or for purposes of placement in a larger container, (not shown), for shipment or storage. Ammunition packages 50A and 50B include container base 51A and 51B respectively. Inner closure element 75A attaches to container base 51A at first eight corner hinge 85A and outer closure element 80A attaches to container base 51A at second eight corner hinge 86A. Similarly, inner closure element 75B attaches to container base 51B at first eight corner hinge 85B and outer closure element 80B attaches to container base 51B at second eight corner hinge 86B. Container base 51A includes footprint 69A and in like manner, container base 51B includes footprint 69B.

Outer closure element 80A includes side rails 95A and 95B and a plurality of lugs the locations of which are typified by lugs 96A and 96B with a similarly positioned pair of lugs, (not shown), formed at an opposite end of outer closure element 80A, all configured to stabilize a second package, in the case of FIG. 10, ammunition package 50B when stacked on top of the first package, in this case ammunition package 50A. More particularly, container base 51B is formed having footprint 69B configured to fit within an area A, shown in FIG. 8, defined between the pair of side rails 95A and 95B and the plurality of lugs typified by lugs 96A and 96B.

Container base 11 of ammunition packages 50A is formed including a plurality of locking tab first elements typified by locking tab first elements 68A and 68B. Outer closure element 80A is formed including a plurality of locking tab second elements typified by locking tab second elements 82A and 82B. When outer closure element 80 is closed over inner closure element 75 the plurality of locking tab first elements typified by locking tab first elements 68A and 68B engage the plurality of locking tab second elements typified by locking tab second elements 82A and 82B to provide for secure closure of ammunition package 50A.

The foregoing description of the illustrated embodiments has been presented for purposes of illustration and description and is not intended to be exhaustive or to limit the invention to the precise form or to exemplary embodiment(s) and implementation(s) disclosed. Modifications and variations will be apparent to practitioners skilled in this art. Process steps described might be interchangeable with other steps in order to achieve the same result. At least one preferred embodiment was chosen and described in order to best explain the principles of the invention and a best mode of practical application, thereby to enable others skilled in the art to understand the invention and the various modifications that are suited to the particular use or implementation contemplated. The scope of the invention is defined by the claims appended hereto and their equivalents. Reference to an element in the singular is not intended to mean "one and only one" unless explicitly so stated, but rather means "one or more." No claim element herein is to be construed under the provisions of 35 U.S.C. Sec. 112, sixth paragraph unless the element is expressly recited using the phrase "means for . . . "

What is claimed is:

1. An ammunition package comprising:

a container base including a bottom panel and a side panel, the bottom panel including an upper face including a plurality of lower cartridge receiving sockets, each of the plurality of lower cartridge receiving sockets including a longitudinal axis, the container base further comprising a first land, a second land and an upper land;

an inner closure element hingedly attached at an upper edge of the container base, the inner closure element foldable between an open position and a closed position;

an outer closure element hingedly attached to the upper edge of the container base, the outer closure element alternately foldable between an open position and a closed position wherein the outer closure element is foldable over the inner closure element when the inner closure element is in the closed position;

a plurality of stabilization plate retainers formed above the first land; and a cartridge stabilization plate including a plurality of apertures, each of the plurality of apertures positioned substantially coaxially to the longitudinal axis of one of the of the plurality of lower cartridge receiving sockets, the cartridge stabilization plate configured to be held in position against the first land by the plurality of stabilization plate retainers.

2. The ammunition package of claim 1 wherein the inner closure element further comprises an inner face including a plurality of upper cartridge receiving sockets, each of the plurality of upper cartridge receiving sockets formed such that when the inner closure element is positioned in the closed position, each of the plurality of upper cartridge receiving sockets are positioned substantially coaxially to the longitudinal axis of one of the of the plurality of lower cartridge receiving sockets.

3. The ammunition package of claim 1 wherein the inner closure element further comprises an upper face formed as a tray, the tray adapted to provide an upwardly facing recess when the inner closure element is folded to the closed position.

4. The ammunition package of claim 1 wherein the inner face of the inner closure element further comprises a plurality of upper cartridge receiving sockets, each of the plurality of upper cartridge receiving sockets formed such that when the inner closure element is positioned in the closed position, each of the plurality of upper cartridge receiving sockets are positioned substantially coaxially to the longitudinal axis of one of the of the plurality of lower cartridge receiving sockets, the inner closure element further comprising an upper face configured as a tray, the tray adapted to provide an upwardly facing recess when the inner closure element is folded to the closed position.

5. The ammunition package of claim 1 further comprising:

the container base including a plurality of sides, the plurality of sides joined to form a plurality of corners, at least one corner of the container base having a convex surface; and the inner closure element further comprising an upper face configured as a tray, the tray adapted to provide an upwardly facing recess when the inner closure element is folded to the closed position, the tray including at least one concave corner adapted to fit cooperatively with the convex surface of the container base.

6. The ammunition package of claim 1 wherein the inner face of the inner closure element is further adapted to contact at least a portion of the first land when the inner closure element is folded to the closed position.

7. The ammunition package of claim 1 wherein the container base further comprises:

a plurality of locking tab first elements formed in the upper land of the container base; and the outer closure element including a plurality of locking tab second elements, each of the locking tab second elements adapted to fit cooperatively with a locking tab first element formed in the upper land of the container base when the outer closure element is positioned in the closed position.

8. The ammunition package of claim 1 further comprising:

a bottom face of the bottom panel of the container base including a plurality of projections corresponding to an exterior surface of the plurality of lower cartridge receiving sockets formed on the inner face of the bottom panel, the plurality of projections defining a plurality of cavities; and the outer closure element including a plurality of upwardly extending stacking lugs formed on an outer surface of the outer closure element, each of the plurality of upwardly facing stacking lugs adapted for a cooperating fit with one of the plurality of cavities when the outer closure element is positioned in the closed position.

9. The ammunition package of claim 1 further comprising a tear-proof adhesive label configured to be wrapped around a periphery of the container base and the inner closure element when the inner closure element and the outer closure element are in the closed position.

10. The ammunition package of claim 1 further comprising:

a first eight corner hinge hingedly attaching the inner closure element to the container base; and a second eight corner hinge hingedly attaching the outer closure element to the container base.

11. An ammunition package comprising:

a container base including a bottom panel and a plurality of side panels, the plurality of side panels joined to form a plurality of corners, the container base further comprising a first land, a second land and an upper land, a plurality of locking tab first elements formed in the upper land of the container base, the bottom panel further comprising an inner face formed having a plurality of lower cartridge receiving sockets, each of the plurality of lower cartridge receiving sockets including a longitudinal axis;

an inner closure element hingedly attached to the upper land of the container base, the inner closure element foldable between an open position and a closed position, an inner face of the inner closure element including a plurality of upper cartridge receiving sockets, the plurality of upper cartridge receiving sockets formed such that when the inner closure element is positioned in the closed position each of the plurality of upper cartridge receiving sockets are positioned substantially coaxially to the longitudinal axis of one of the of the plurality of lower cartridge receiving sockets, the inner closure element further comprising a tray configured to provide an upwardly facing recess when the inner closure element is folded to the closed position;

an outer closure element hingedly attached to the upper land of the container base, the outer closure element alternately foldable between an open position and a closed position wherein the outer closure element is foldable over the inner closure element when the inner closure element is in the closed position, the outer closure element including a plurality of locking tab second elements, each of the locking tab second elements adapted to fit cooperatively with a locking tab first element formed in the upper land when the outer closure element is positioned in the closed position;

a plurality of stabilization plate retainers formed above the first land; and a cartridge stabilization plate including a plurality of apertures, each of the plurality of apertures positioned substantially coaxially to the longitudinal axis of one of the of the plurality of lower cartridge receiving sockets, the cartridge stabilization plate configured to be held in position against the first land by the plurality of stabilization plate retainers.

12. The ammunition package of claim 11 further comprising:

at least one corner of the container base having a convex surface; and the tray adapted to provide an upwardly facing recess when the inner closure element is folded to the closed position including at least one concave corner adapted to fit cooperatively with the convex surface of the container base.

13. The ammunition package of claim 11 wherein the inner face of the inner closure element is adapted to contact at least a portion of the first land when the inner closure element is folded to the closed position.

14. The ammunition package of claim 11 further comprising:

a bottom face of the bottom panel of the container base including a plurality of projections corresponding to an exterior surface of the plurality of lower cartridge receiving sockets formed on the inner face of the bottom panel, the plurality of projections defining a plurality of cavities; and the outer closure element including a plurality of upwardly extending stacking lugs formed on an outer surface of the outer closure element, each of the plurality of upwardly facing stacking lugs adapted for a cooperating fit with one of the plurality of cavities when the outer closure element is positioned in the closed position.

15. The ammunition package of claim 11 wherein the outer closure element further comprises a pair of side rails upwardly extending from an outer surface of the outer closure element, the pair of side rails positioned in a spaced apart relationship, the pair of side rails adapted to provide a stacked container receptacle.

16. The ammunition package of claim 11 further comprising a tear-proof adhesive label configured to be wrapped around a periphery of the container base and the inner closure element when the inner closure element and the outer closure element are in the closed position.

17. The ammunition package of claim 11 further comprising:

a first eight corner hinge hingedly attaching the inner closure element to the container base; and a second eight corner hinge hingedly attaching the outer closure element to the container base.

18. An ammunition package comprising:

a container base including a bottom panel and a plurality of side panels, the plurality of side panels joined to form a plurality of corners, an interior surface of the container base including a stepped configuration defined by a first land, a second land and an upper land, a plurality of locking tab first elements formed in the upper land of the container base, the bottom panel further comprising an inner face formed having a plurality of lower cartridge receiving sockets, each of the plurality of lower cartridge receiving sockets including a longitudinal axis;

an inner closure element hingedly attached to the upper land of the container base, the inner closure element foldable between an open position and a closed position, an inner face of the inner closure element including a plurality of upper cartridge receiving sockets, the plurality of upper cartridge receiving sockets formed such that when the inner closure element is positioned in the closed position each of the plurality of upper cartridge receiving sockets are positioned substantially coaxially to the longitudinal axis of one of the of the plurality of lower cartridge receiving sockets, the inner closure element further comprising a tray configured to provide an upwardly facing recess when the inner closure element is folded to the closed position, the inner closure element further comprising, the inner face adapted to contact at least a portion of the first land when the inner closure element is folded to the closed position; and an outer closure element hingedly attached to the upper land of the container base, the outer closure element alternately foldable between an open position and a closed position wherein the outer closure element is foldable over the inner closure element when the inner closure element is in the closed position, the outer closure element including a plurality of locking tab second elements, each of the locking tab second elements adapted to fit cooperatively with one of the plurality of locking tab first elements formed in the upper land when the outer closure element is positioned in the closed position.

* * * * *